US010039688B1

(12) United States Patent
Epp

(10) Patent No.: US 10,039,688 B1
(45) Date of Patent: Aug. 7, 2018

(54) WALKER GLIDE

(71) Applicant: Robert Epp, Holderness, NH (US)

(72) Inventor: Robert Epp, Holderness, NH (US)

( * ) Notice: Subject to any disclaimer, the term of this patent is extended or adjusted under 35 U.S.C. 154(b) by 0 days.

(21) Appl. No.: 15/424,042

(22) Filed: Feb. 3, 2017

(51) Int. Cl.
*A61H 3/04* (2006.01)

(52) U.S. Cl.
CPC ..... *A61H 3/04* (2013.01)

(58) Field of Classification Search
CPC .... A61H 3/04; A61H 3/00; A61H 2003/0205; A61H 2003/0294; A61H 3/0288
See application file for complete search history.

(56) References Cited

U.S. PATENT DOCUMENTS 2,835,493 A * 5/1958 Skaggs ..... A63B 25/00 482/75
3,421,773 A * 1/1969 Pearson ..... B62B 13/04 280/826
3,738,674 A * 6/1973 Pauls ..... A61H 3/0288 135/66
3,868,122 A * 2/1975 Negi ..... A63C 11/22 135/70
4,044,784 A * 8/1977 Smith ..... A45B 7/00 135/65
4,094,330 A 6/1978 Jong
4,411,284 A * 10/1983 Opitz ..... A45B 9/04 135/81
4,440,186 A * 4/1984 Lottner ..... A45B 9/04 135/84
4,510,957 A * 4/1985 Frank ..... A45B 9/04 135/79
4,708,154 A * 11/1987 Edwards ..... A61H 3/0288 135/84
4,711,595 A * 12/1987 Magid ..... B25B 27/14 403/108
4,800,910 A 1/1989 Gamm
4,995,412 A * 2/1991 Him ..... A61H 3/00 135/67
5,224,506 A * 7/1993 Allen ..... A61H 3/04 135/67
5,318,058 A * 6/1994 Zimmerman ..... A61H 3/02 135/68
D349,144 S * 7/1994 Greene ..... D21/775
5,375,938 A * 12/1994 Bartlow ..... B25G 1/04 15/144.4
5,509,172 A 4/1996 Lauro
5,782,256 A * 7/1998 Bradley ..... A61H 3/04 135/77

(Continued)

FOREIGN PATENT DOCUMENTS

CN 201313483 9/2009

*Primary Examiner* — Jacob B Meyer
(74) *Attorney, Agent, or Firm* — Lambert & Associates; Gary E. Lambert; David J. Connaughton, Jr.

(57) ABSTRACT

A walker glide is provided. The walker glide has a base configured to support the walker and glide along a floor or other surface that the walker is being used on. A shaft extends from the base and comprises the attaching structure to connect the glide to a leg of the walker. The shaft includes two fingers which extend into the leg of the walker and are flexible towards each other. A protrusion extends from outer faces of each finger. The protrusion is configured to mate with an aperture in each side of the leg, thereby removably securing the glide in place.

20 Claims, 3 Drawing Sheets

(56) References Cited

U.S. PATENT DOCUMENTS 5,911,235 A * 6/1999 Henderson ..... A61H 3/04 135/85
6,079,894 A * 6/2000 Obitts ..... A61H 3/02 135/75
6,138,699 A * 10/2000 Su ..... A45B 9/04 135/68
6,164,305 A * 12/2000 Herman ..... A61H 3/02 135/68
6,206,019 B1 * 3/2001 Horvitz ..... A61H 3/00 135/66
6,217,073 B1 * 4/2001 Hoffman ..... A63C 11/221 135/66
D442,123 S * 5/2001 Johnston ..... D12/133
6,276,007 B1 * 8/2001 Brown ..... A61G 7/053 135/84
6,413,004 B1 * 7/2002 Lin ..... B25B 7/02 403/171
6,467,747 B1 * 10/2002 Ellsworth ..... G09F 3/12 248/408
6,474,692 B1 * 11/2002 Farah ..... A63C 17/0013 280/826
6,854,916 B2 * 2/2005 Hsieh ..... F16B 7/105 403/109.1
6,854,919 B2 * 2/2005 Neumann ..... B25G 1/04 15/145
7,735,499 B1 6/2010 Pennise
8,166,990 B2 * 5/2012 Daily ..... A45B 7/00 135/65
8,746,266 B2 * 6/2014 Palmer ..... A45B 9/04 135/82
8,789,547 B1 * 7/2014 Reda ..... A61H 3/00 135/77
8,864,151 B1 10/2014 Liu
9,131,754 B2 * 9/2015 Basham ..... A45B 9/00
9,512,865 B2 * 12/2016 Wang ..... F16B 7/105
9,554,961 B1 * 1/2017 Juarez ..... A43B 5/0419
9,681,714 B1 * 6/2017 Yeh ..... A45B 9/04
9,707,149 B1 * 7/2017 Juarez ..... A61H 3/00
2002/0010961 A1 * 1/2002 Brown ..... A61G 7/053 5/81.1 RP
2006/0219280 A1 * 10/2006 Robinson ..... A61H 3/0288 135/84
2007/0169308 A1 * 7/2007 Chiu ..... A47B 91/06 16/42 R
2010/0133769 A1 6/2010 Wu
2010/0229346 A1 * 9/2010 Chiu ..... A47B 91/06 16/42 T
2010/0229903 A1 * 9/2010 Ozuna ..... A45B 9/04 135/73
2011/0005559 A1 * 1/2011 Daily ..... A45B 7/00 135/68
2014/0182642 A1 * 7/2014 Basham ..... A45B 9/00 135/82

* cited by examiner

WALKER GLIDE

BACKGROUND OF THE INVENTION

Field of the Invention

The present invention relates generally to walker glides. More particularly the present invention relates to a snap fit replacement walker ski glide.

Description of Related Art

Ambulatory aids such as walkers, crutches, and canes have various forms of feet or tips which make alternating or sliding contact with the floor when in use. Conventional walkers have rubber tips which many users have difficulty maneuvering over carpet edges, sidewalk seams and other impediments. Clearing such elevated obstacles requires lifting the walker, which may be difficult for some users.

Failure to clear these obstacles can potentially lead to a loss of balance. One conventional walker foot that alleviates some of these problems is a ski-shaped glide. Such devices can be made of nylon and includes a rectangular ski-shaped base which curves upwardly at the front edge of the ski. Typically screws or other structures fit through a bottom of the glide, leading to an opening in the bottom sliding face. These openings can trap debris and catch on surfaces. Other shortcomings of the prior art includes the nylon material wearing out quickly and the glides not being securely fastened to the walker. Further, these walker glides are difficult to connect and replace.

Therefore, what is needed is a walker glide structure that may be easily installed and removed, that also provides long life with minimal wear.

SUMMARY OF THE INVENTION

The subject matter of this application may involve, in some cases, interrelated products, alternative solutions to a particular problem, and/or a plurality of different uses of a single system or article.

In one aspect, a walker glide is provided. The walker glide is configured for attachment to a walker leg. The walker glide has a base configured to be slid along the surface that the walker is on. A shaft extends upwardly from the base and has a connecting structure to attach the glide to the leg of the walker. Fingers extend from the shaft. These fingers are separated by a spacing and are inwardly flexible into the spacing, towards each other. A protrusion extends from each finger at the outer surface of the finger. Each protrusion can interface with an aperture of the walker leg to hold the glide in place. A removal of the glide can be achieved by urging the protrusions inward out of engagement with the leg apertures, and then pulling the glide out of the leg.

In another aspect, a walker is provided. The walker has a handle area with a plurality of legs connected thereto. A glide is attached to a distal end of at least one of these legs. The glide has a base with a shaft extending upwardly from a top of the base. A connecting structure of the shaft allows the glide to be attached to the leg of the walker. In one embodiment, the connecting structure is formed as fingers extend from the shaft. These fingers are separated by a spacing and are inwardly flexible into this spacing, towards each other. A protrusion extends from each finger at the outer surface of the finger. This protrusion is interfaced with an aperture in the leg and thus holds the glide in place.

DETAILED DESCRIPTION

Figure 1:
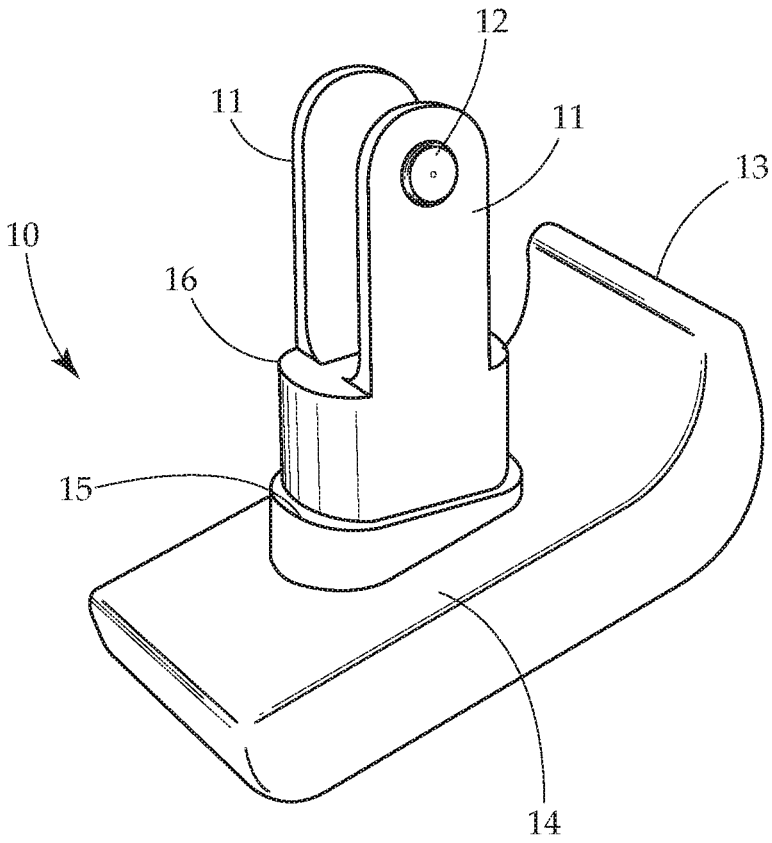
FIG. 1 provides a perspective view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a walker glide which is configured to connect to a bottom of a walker leg and slide along the ground or surface that the walker is on. This walker glide has a base on which the sliding occurs, a shaft extending from the base, and at least one, typically two fingers that extend upward from the shaft with protruding tabs on the outer faces of the fingers. These protruding tabs are configured to pass through an opening of the walker leg.

The base of the present invention may be any shape that allows it to provide support and stability to the walker leg that can also slide across the surface on which the walker is being used. In one embodiment, the walker glide may have a ski shape, with a front end curving upwardly. In some embodiments, the base may have a smooth bottom surface without any substantial apertures therein. Specifically, the bottom surface may be without an aperture through which a screw may pass. In a particular embodiment, the base may have a smooth liner material on its bottom surface to facilitate sliding. In another embodiment, the base may be formed of a single material that is slideable without excessive friction along a surface that it is on.

The shaft extends upwardly from the base and provides the part of the glide that attaches to the walker leg. In one embodiment, the shaft has a uniform thickness. In another embodiment a lower shaft portion may have a cross sectional diameter or thickness greater than that of the walker leg to allow an end of the walker leg to abut against it. An upper shaft may have a diameter or thickness less than or equal to an inner diameter or inner spacing of the walker leg (typically formed as a tube having a hollow interior).

This allows the upper shaft to fit within the walker leg. In some embodiments, the shaft or upper shaft has a cross sectional shape that matches the cross section of the inner diameter/spacing of the walker leg. In another embodiment, with a walker leg having a rounded interior cross section, only a front and rear of the shaft or upper shaft may match the rounded interior of the walker leg, having straight sides that do not contact a side wall portion of the walker leg. It should be understood that the shaping of the shaft is not limiting to this invention, and indeed it may be any shape.

In one embodiment, the shaft may extend upwardly perpendicularly from the base. In another embodiment, the shaft may extend at a slight angle (+/−30 degrees from perpendicular) from the base. Generally this angling is towards a front of the glide base, but this is not necessarily so.

Extending from a top part of the upper shaft are a finger or fingers in the same or substantially the same direction (+/−15 degrees) as the shaft. The fingers are formed and shaped so as to fit within the inner diameter of the walker leg. Further, the fingers are formed of a resilient but flexible material. This allows them to be bent inward when being moved into and out of the walker leg, and also to urge the protrusions through the openings of the walker leg. A spacing between the two fingers allows a tab protruding from their outer edges to bend inward towards each other to fit within the walker leg inner diameter.

The tab protruding from the outside of the finger or fingers are configured and sized to pass through, or otherwise interface with an aperture in the walker leg. These tabs may be of any shape. In one particular embodiment, the tabs may be round button shaped protrusions. In another embodiment, the tabs may have a ramp shape facing upward on the walker glide (that is, facing away from the base). In this embodiment, the ramped shape may allow the walker glide fingers to be automatically bent inward when pushed against the walker leg side wall. A bottom and/or side portions of the tabs typically may not have ramped faces to prevent accidental removal from pulling or rotational movements.

The present invention may be formed of any material resilient enough to be inserted into a walker leg and to support the weight of the walker and user when slid across the surface that the walker is on. Generally, materials of which the present invention may be made include hard plastics, metals, fiberglass or other composite materials, wood, and the like. The present invention may be formed of a single material, or may be formed of a number of different materials on different portions.

While operation of the protrusion-leg interface is generally herein discussed by using resilient fingers to urge the protrusion outward and allow its inward depression, it should be understood that any similar structure may be utilized without straying from the scope of this invention. For example, a shaft may have a spring loaded button that is biased outward by a spring force, but can be depressed inwardly against this spring force.

Turning now to FIG. 1, a perspective view of an embodiment of the glider is provided. In this view, the walker glide 10 has a base 14 which is slideable on a surface, such as a floor or the ground, that a walker (not shown) is positioned on. The base 14 has an upwardly sloped ski-shaped front 13. A shaft extends upwardly from a top of the base 14. The shaft includes a lower portion 15 and upper portion 16. The shaft lower portion 15 may be sized to be wider than an inner diameter of the walker leg. An edge of the top of the shaft lower portion 15 may provide a seat on which the walker leg may sit. An upper shaft portion 16 is more narrow than the shaft lower portion 15, and is sized to fit within an inner space of the walker leg (not shown). Two fingers 11 extend upwardly from the upper shaft 16.

Protrusions 12 extend from outward facing sides of the fingers 11. These fingers 11 are formed to be somewhat flexible along their length so as to urge protrusions 12 outward into a slot when in position on a walker leg. As noted above, the various portions of the shaft 15, 16, 11, and 12 may be any shape without straying from the scope of this invention. While in many embodiments, two protrusions and flexible fingers are contemplated, an embodiment containing only one depressible protrusion is contemplated herein and is within the scope of the present invention.

Figure 2:
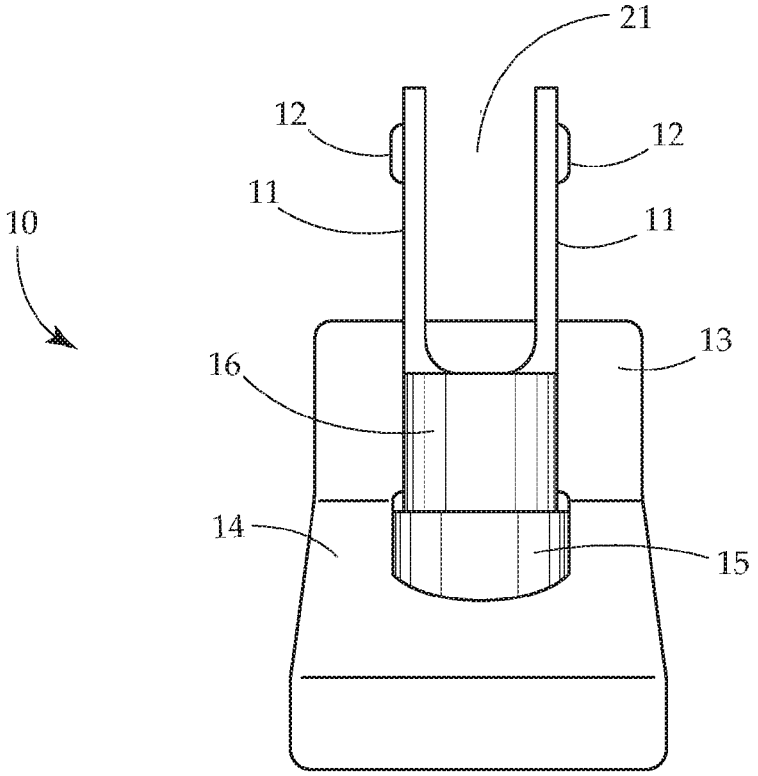
FIG. 2 provides a rear view of the present invention.

FIG. 2 shows a rear view of another embodiment of the present invention. The glider 10 base 14 has a lower shaft portion 15 extending from its top surface. Upper base portion 16 is above the lower base portion 15, and fingers 11 extend upwardly from the upper base portion 16. Protrusions 12 extend from both sides of the fingers 11 on their outer faces. A spacing 21 between the fingers 11 allows them to be bent inwardly into this spacing 21 for the purposes of inserting and removing the glide 10 from the walker leg.

Figure 3:
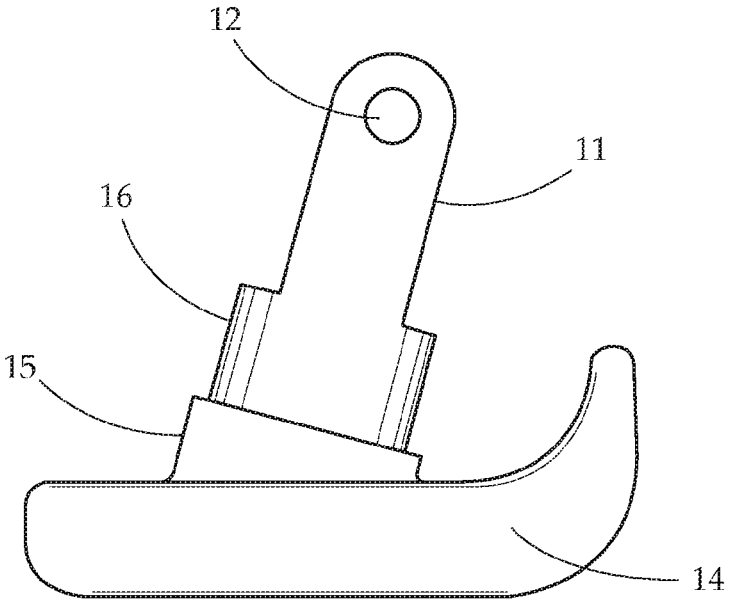
FIG. 3 provides a side view of the present invention.

FIG. 3 provides a side view of the walker glide of the present invention. In this embodiment, shaft portions 15, 16, 11 are angled forward towards the ski shaped front 13. In varying embodiments, angling of the shaft may be towards the ski shaped front 13, straight up and down, or back towards a rear of the base 14. This angling typically may be configured to match an angle of the walker leg that the glide 10 is intended to be slid into so that the glide base 14 can be approximately parallel (+/−15 degrees) to a surface on which is it intended to slide.

Figure 5:
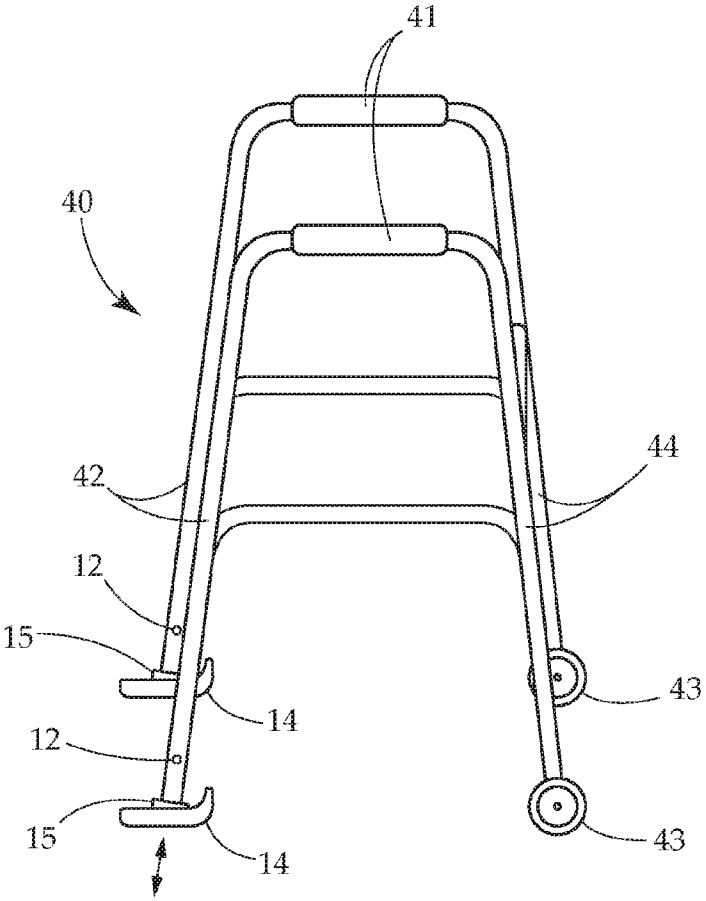
FIG. 5 provides a side view of a walker having the present invention installed on a rear set of walker legs.
Figure 4:
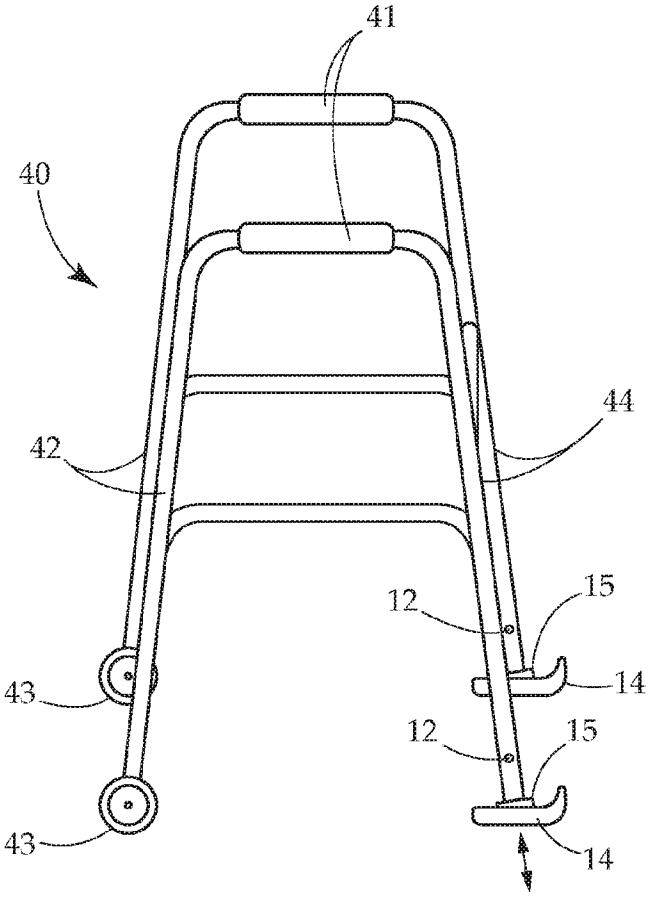
FIG. 4 provides a side view of a walker having the present invention installed on a front set of walker legs.

FIGS. 4 and 5 show views of the present invention installed on a walker. In FIG. 4, the walker glide 10 is installed on the front two legs of the walker 40. In FIG. 5, the walker glide 10 is installed on the rear legs of the walker 40. Walker 40 is formed of four legs, front legs 44 and rear legs 42. Handles 41 on a top portion of the walker 40 are approximately parallel to the ground. Two wheels 43 are positioned on the two legs opposite to the glides 10. However, it should be understood that other structures, including additional glides 10 may be used instead of wheels 43. As installed, leg 44 in FIG. 4, and 42 in FIG. 5, rests on lower base portion 15. Upper base portion 16 and fingers 11 extend into an interior opening of leg 44 or 42. Protrusions 12 can be seen extending through an aperture in the legs 44, 42. This protrusion and leg aperture arrangement holds the glides in place.

In use, to remove the glide 10, protrusions 12 are pushed inwardly against the resilient force of the fingers 11 until they are no longer interacting with the leg apertures. At this point, the glide 10 can be pulled from the leg 42 or 44 in the direction of the arrow, and once the fingers 11 are removed they will return to their resting position. Similarly, to install a glide 10, a user may pinch the fingers 11 inward into the spacing 21 between them such that the protrusions do not block entry of the shaft 16 by the walker leg 44, or 42. Once inserted into the leg 44, 42, the user may maneuver the glide 10 by, for example, its base 14, until the protrusions 12 mate with the apertures of the leg 44 or 42, at which point the glide 10 will be snap fit in place. Once locked in place, a user may use the walker 40 by sliding the glides 10 along the surface to support the weight of the user and allow for convenient and stable movement.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A walker glide for attachment to a walker comprising:

a base configured to be slid along a surface, the base having a smooth bottom surface without any substantial apertures;

a shaft extending upwardly from the base;

two fingers extending upwardly from the shaft, the fingers being separated by a spacing and flexible towards each other into the spacing;

a protrusion on an outer surface of each of the two fingers, the protrusion configured to interface with an aperture of a leg of the walker.

2. The walker glide of claim 1 wherein a front of the base comprises a ski-shaped portion.

3. The walker glide of claim 1 wherein the base is formed of plastic.

4. The walker glide of claim 1 wherein the glide is formed of a single material.

5. The walker glide of claim 1 wherein the shaft is angled toward a front of the base.

6. The walker glide of claim 2 wherein the shaft is angled toward the ski-shaped portion.

7. The walker glide of claim 1 wherein the shaft comprises a lower portion that is wider than the leg of the walker, and an upper portion that is sized to fit within the walker leg, the fingers extending from the shaft upper portion.

8. The walker glide of claim 7 wherein the shaft upper portion has a cross sectional shape matching a cross sectional shape of an opening of the walker leg.

9. The walker glide of claim 7 wherein a portion of the shaft upper portion has a rounded side that matches an inner diameter of the walker leg.

10. The walker glide of claim 1 wherein the protrusion comprises a ramp-shaped portion facing a top of the finger.

11. The walker glide of claim 1 wherein each of the two fingers is formed of a resilient flexible material.

12. A walker comprising:

a handle area;

a plurality of legs connected to the handle area;

a glide attached to a distal end of one of the plurality of legs, the glide comprising:

a base configured to be slid along a surface that the walker is on, the base having a smooth bottom surface without any substantial apertures;

a shaft extending upwardly from the base into the one of the plurality of walker legs;

two fingers extending upwardly from the shaft, the fingers being separated by a spacing and flexible towards each other into the spacing;

a protrusion on an outer surface of each of the two fingers, each protrusion interfaced with an aperture of the leg of the walker, holding the glide to the one of the plurality of walker legs.

13. The walker of claim 12 comprising four legs, a second glide connected to a second of the four legs.

14. The walker of claim 12 wherein a front of the glide base comprises a ski-shaped portion.

15. The walker of claim 12 wherein the glide shaft is angled toward a front of the base.

16. The walker of claim 14 wherein the glide shaft is angled toward the ski-shaped portion.

17. The walker of claim 12 wherein the glide shaft comprises a lower portion that is wider than the distal end of the one of the plurality of legs of the walker, and an upper portion extending within the one of the plurality of walker legs, the fingers extending from the upper portion.

18. The walker of claim 12 wherein the protrusion comprises a ramp-shaped portion facing a top of the finger.

19. The walker of claim 12 wherein each of the two fingers is formed of a resilient flexible material.

20. The walker of claim 7 wherein the shaft upper portion has a shape matching an opening of one of a plurality of walker legs.

* * * * *